US005407379A

United States Patent [19]

Shank et al.

[11] Patent Number: 5,407,379

[45] Date of Patent: Apr. 18, 1995

[54] DIFFERENTIAL PRESSURE METERING AND DISPENSING SYSTEM FOR ABRASIVE MEDIA

[75] Inventors: James D. Shank, Vestal, N.Y.; William E. Spears, Jr., Lawrenceville, N.J.; Michael E. Miner, Sugar Land, Tex.

[73] Assignee: Church & Dwight Co., Inc., Princeton, N.J.

[21] Appl. No.: 229,010

[22] Filed: Apr. 18, 1994

[51] Int. Cl.[6] ..... B24C 7/00

[52] U.S. Cl. ..... 451/99; 451/101

[58] Field of Search ..... 51/436, 438, 319, 410, 51/320, 321; 137/599, 606, 607; 451/99, 101, 102, 75, 39, 40

[56] References Cited

U.S. PATENT DOCUMENTS

| | | | |
|---|---|---|---|
| 2,200,587 | 2/1937 | Tirrell | 51/438 |
| 3,201,901 | 9/1963 | Pauli | 51/436 |
| 3,793,778 | 2/1974 | Price | 51/436 |
| 4,387,020 | 6/1983 | Hill | 210/86 |
| 5,081,799 | 1/1992 | Kirschner et al. | 51/410 |
| 5,083,402 | 1/1992 | Kirschner et al. | 51/319 |
| 5,101,847 | 4/1992 | Oribe | 137/1 |
| 5,230,185 | 7/1993 | Kirschner et al. | 51/410 |
| 5,283,990 | 2/1994 | Shank, Jr. | 51/427 |

*Primary Examiner*—Bruce M. Kisliuk
*Assistant Examiner*—Derris H. Banks
*Attorney, Agent, or Firm*—Charles B. Barris

[57] ABSTRACT

Improvements to blast cleaning apparatus, and particularly to a media control device which contains a fixed orifice placed between the abrasive supply pot and a media outlet to the compressed air line to meter the media flow into the air line and means to maintain a positive pressure differential between the supply pot and the air line further includes a means to equalize the pressure between the air line and a media passage immediately below the orifice. An additional improvement comprises adding a flow straightening device upstream of a bend in the air line so as to reduce back-mixing in the bend and consequently the turbulence of air downstream of the bend and across the media outlet into the air line.

20 Claims, 3 Drawing Sheets

DIFFERENTIAL PRESSURE METERING AND DISPENSING SYSTEM FOR ABRASIVE MEDIA

BACKGROUND OF THE INVENTION

The present invention is concerned, in general, with improvements to blast cleaning apparatus and, in particular, with improvements to a media valve and a metering and dispensing system used to control by means of differential pressure the amount of abrasive media directed into a compressed air stream.

Standard sand blasting equipment consists of a pressure vessel or supply pot to hold particles of a blasting medium such as sand, a source of compressed air connected to the supply pot via a conveying hose and a means of metering the blasting medium from the supply pot, which operates at a pressure that is the same or slightly higher than the conveying hose pressure. The sand/compressed air mixture is transported to a nozzle where the sand particles are accelerated and directed toward a workpiece. Flow rates of the sand or other blast media are determined by the size of the equipment. Commercially available sand blasting apparatus typically employ media flow rates of 10–20 pounds per minute. About 0.5 to 1 pound of sand are used typically with about 1.0 pound of air, thus yielding a ratio of 0.5 to 1.0.

When it is required to remove coatings such as paint or to clean relatively soft surfaces such as aluminum, magnesium, plastic composites and the like, or to avoid surface alteration of even hard materials such as stainless steel, less aggressive abrasives, including inorganic salts such used in place of sand in conventional sand blasting equipment. The media flow rate used for the less aggressive abrasives is substantially less than that used for sand, and has been determined to be from about 0.5 to about 10.0 pounds per minute, using similar equipment. The lower flow rates require a much lower media to air ratio, in the range of about 0.05 to 0.5.

However, difficulties are encountered in maintaining continuous flow at these low flow rates when conventional sand blasting equipment is employed. The fine particles of an abrasive media such as sodium bicarbonate are difficult to convey by pneumatic systems by their very nature. Further, the bicarbonate media particles tend to agglomerate upon exposure to a moisture-containing atmosphere, as is typical of the compressed air used in sand blasting. Flow aids such as hydrophobic silica have been added to the bicarbonate in an effort to improve the flow, but maintaining a substantially uniform flow of bicarbonate material to the blast nozzle has been difficult to achieve. Non-uniform flow of the blast media leads to erratic performance, which in turn results in increased cleaning time and even to damage of somewhat delicate surfaces.

Commonly assigned U.S. Pat. Nos. 5,081,799 and 5,083,402 disclose a modification of conventional blasting apparatus by providing a separate source of line air to the supply pot through a pressure regulator to provide a greater pressure in the supply pot than is provided to the conveying hose. This differential pressure is maintained by an orifice having a predetermined area and situated between the supply pot and the conveying hose. The orifice provides an exit for the blast media and a relatively small quantity of air from the supply pot to the conveying hose, and ultimately to the nozzle and finally the workpiece. The differential air pressure, typically operating between 1.0 and 5.0 psi with an orifice having an appropriate area, yields acceptable media flow rates in a controlled manner. The entire contents of U.S. Pat. Nos. 5,081,799 and 5,083,402 are herein incorporated by reference.

A media metering and dispensing valve which meters and dispenses the abrasive from the supply pot through the orifice and to the conveying hose carrying the compressed air stream typically operates automatically whenever the compressed air is applied to the blast hose to begin the abrasive blasting operation. The media valve for use in the afore-mentioned metering and dispensing process as disclosed in U.S. Pat. Nos. 5,081,799 and 5,083,402 is characterized as a Thompson valve and is described in detail in U.S. Pat. No. 3,476,440, the contents of which are herein incorporated by reference. The Thompson valve includes a metering valve stem which blocks the outlet of a discharge tube disposed between the supply pot and an air flow tube which is secured to and carries the compressed air to the conveying hose. When the blast nozzle is activated, the valve stem is lifted from the valve seat of the Thompson valve and allows a controlled amount of media to flow through the outlet of the discharge tube into the air flow tube. The valve as disclosed in U.S. Pat. No. 3,476,440 has been improved by placing the valve stem within a control sleeve which contains a plurality of orifices having different sizes, one of which can be placed in communication with the outlet of the discharge tube and the air flow tube. When the valve stem is seated within the valve body and closed, the orifice in the control sleeve is blocked such that media cannot flow from the discharge tube through the orifice in the media control sleeve and then into the air flow tube. Upon operation of the blast nozzle, the valve stem is pulled away from the orifice to allow the media flow from the pot to the discharge tube, through the orifice and into the air flow tube.

The plurality of orifices provides another means of controlling the amount of media flowing from the supply pot into the compressed air stream and into the blast nozzle apparatus. Unfortunately, to change the orifice which is in alignment with the media discharge tube and the air flow tube or to clean out a plugged orifice in the Thompson valves now on the commercial market, it is required that the valve body holding the stem be taken apart, the valve sleeve taken out, rotated, placed back in its slot and the valve body then restructured. Obviously such disassembly and reassembly is cumbersome and certainly does not allow for efficient blast cleaning on the job site.

The present assignee has developed a novel and improved media control valve which is particularly useful in the differential pressure metering system of U.S. Pat. Nos. 5,081,799 and 5,083,402. The improved metering valve offers additional control with respect to metering the flow of media. Like the prior art Thompson media control valves, the novel valve includes a control sleeve which contains a plurality of orifices, one of which can be aligned to communicate with the discharge of the media from the supply pot and the air flow tube to dispense the media into the compressed air stream. The plurality of orifices have a different diameter to allow enhanced control of the amount of media dispensed from the supply pot to the compressed air flow tube by allowing a change of orifice size. Importantly, to control the metering of the abrasive media into the air flow tube, the control sleeve can be rotated while in place in the valve body to align a different orifice with the media discharge passage in communication with the supply pot and the compressed air flow tube. Alternative embodiments are provided to index the control sleeve such that an orifice is properly aligned upon rotation of the control sleeve. In one embodiment, the index means comprises a ball spring plunger placed in the valve body and exerted against the control sleeve and a series of detents spaced in the sleeve and aligned with each orifice so as to properly align the orifice with the media discharge passage from the supply pot and the air flow tube when the ball spring plunger fits within a detent in the sleeve. The control sleeve which contains the valve stem can be easily removed from the valve body in one piece for cleaning and replaced and locked in place in the valve body by means of a lock pin without disassembling the body of the valve. In the second embodiment, the index means comprises a plurality of grooves which are placed on the face of the bore which receives the control sleeve and which mate with a plurality of teeth on the control sleeve. The teeth are aligned with the orifices. To change orifices, the control sleeve is lifted to disengage the teeth from the grooves and rotated until the teeth and grooves are again aligned and the sleeve then dropped in place in the valve body. The media control valve also includes a manually adjustable multi-port valve placed within the media discharge passage and which can close off the discharge passage from the supply pot, and allow compressed air to back clean the valve and direct debris out a clean-out port in the valve body. The novel and improved media control valve is described in commonly assigned, copending application, U.S. Ser. No. 161,530, filed Dec. 6, 1993, the entire contents of which are herein incorporated by reference.

Although the improved media valve as described in the above commonly assigned, copending application can be used with any system which meters the abrasive media from the supply pot to the compressed air line, the improved valve has particular use in the differential pressure supply system as described in above-mentioned commonly assigned U.S. Pat. Nos. 5,081,799 and 5,083,402. While the media flow rates achieved utilizing these patented control systems have been found acceptable, it is has been found that improvements can be made. In particular, it has been found that the media flow rates can sometimes be inconsistent during the blast cleaning operation. It is believed that these inconsistencies are due to the presence of turbulent air below the orifice which causes the media to "see" a slightly different air pressure than what is actually present in the compressed air line into which the media is ultimately dispensed. The turbulence is believed to be caused by the air passing across the outlet of the media discharge tube which carries the abrasive media from the orifice into the air flow tube. The air turbulence at the discharge tube outlet can vary the air pressure immediately below the orifice. Since the differential air pressure between the supply pot and the air line which is calculated and used to meter the abrasive media operates only between 1.0 and 5.0 psi, fluctuations in the air pressure immediately below the orifice can result in an inaccurate real time differential pressure and consequent inconsistent media flow rates through the orifice and variations in the ultimate media concentration in the compressed air stream. In particular with sodium bicarbonate media in which lower amounts of media are utilized per amount of compressed air, small changes in the concentration of the media in the compressed air can result in pronounced uneven blast cleaning.

Sodium bicarbonate media is lighter than the sand abrasive and accordingly, the bicarbonate media can be more easily manipulated by control of air pressure. Thus, minor changes in the apparatus used to control media flow from the hopper to the air line are very useful in manipulating the flow of the bicarbonate media. While the improved media valve utilized to control the media flow is useful with any abrasive, it has been found particularly useful with the lighter bicarbonate media inasmuch as controlling the flow rate of a sand abrasive cannot be readily achieved by small changes in the metering apparatus due to the heavier density and mass of the sand abrasive particle. Flow rate control of sand relies typically on gravity flow alone.

Another cause of turbulent air is found in the orientation of the compressed air line itself. Typically, due to the confines of space, the compressed air line from the compressed air supply source often bends immediately before passing across the outlet of the discharge tube from the media control valve. The air flow immediately past the bend is often turbulent, again, resulting in inconsistencies between the calculated and real time differential pressure between the media supply hopper and the compressed air line immediately below the orifice of the valve.

Accordingly, it is an object of the present invention to provide improvements in the metering and dispensing apparatus described in U.S. Pat. Nos. 5,081,799 and 5,083,402.

It is another object of the present invention to provide an improved metering and dispensing system for metering an abrasive into a compressed air line by means of differential pressure between the supply of abrasive media and the compressed air line.

Still another object of the present invention is to provide for more uniform metering and dispensing of an abrasive into a compressed air line using a differential air pressure metering system and a Thompson media control valve wherein the abrasive media is passed through an orifice and into the compressed air line.

Yet another object of the invention is to reduce turbulent air flow through the compressed air line at the point of contact with the media outlet from the metering valve.

SUMMARY OF THE INVENTION

The present invention is concerned with improvements in the metering and dispensing system described in U.S. Pat. Nos. 5,081,799 and 5,083,402 for dispensing an abrasive media from a supply pot into a compressed air line and which comprises a separate source of line air to a supply pot through a pressure regulator to provide a greater pressure in the supply pot than is provided to the conveying hose and wherein the differential pressure is maintained by an orifice having a predetermined area situated between the supply pot and the conveying hose. The orifice is typically contained in a Thompson valve such as described in U.S. Pat. No. 3,476,440 and similar valve such as the improved valve described in aforementioned, commonly assigned U.S. Ser. No. 161,530.

The improvement in the metering and dispensing system comprises the addition of an equalization tube communicating between the compressed air line upstream of where the compressed air line passes the outlet of the media discharge tube of the valve into the compressed air line, and the area immediately below the orifice so that the abrasive media passing through the orifice "sees" the correct air line pressure. The equalization tube removes or at least greatly reduces the nonuniformities in air pressure below the orifice of the valve which previously resulted from turbulent flow as compressed air in the air line passed across the discharge tube outlet. Accordingly, a uniform differential air pressure can be maintained between the supply pot and the air line immediately below the orifice so as to provide uniform metering of the abrasive from the supply pot into the air line.

An additional improvement of this invention involves including an air flow straightening device in the air line. The air flow straightening device is placed upstream of the bend in the air line which bend is located in typical blasting apparatus immediately upstream of the location where the abrasive media passes into the air line. By reducing turbulent flow in the air line, the equalization tube also provides the correct air line pressure to the area below the orifice of the differential pressure metering and dispensing system and provides for uniform and accurate metering of the abrasive across the orifice of the media control valve.

DETAILED DESCRIPTION OF THE INVENTION

The invention can best be described by referring to the method of controlling the metering of the abrasive media into the compressed air stream using differential pressure as disclosed in U.S. Pat. No. 5,083,402. In order to feed fine particles of a material such as a bicarbonate abrasive having a mean particle size of from 50 to 1000 microns, preferably from about 200 to 300 microns, at a uniform rate, pressures within the supply pot, including the blast hose pressure, must be positive with respect to the nozzle. Pressures are typically in the range of about 20–125 psig.

Since the supply pot and the conveying hose operate at about the same pressure, the flow of blast media in conventional sand blasting equipment is controlled by gravity feed and a metering valve. It has been found, however, that the supply pot was under a small differential pressure with respect to the blast delivery hose pressure, which fluctuated between positive and negative. The result was that the flow rates of the blast media fluctuated also in response to the differential pressure changes. Accordingly, a differential pressure gauge has been installed between the delivery hose and the supply pot to monitor the differential pressure directly. The pressure can be closely controlled by means of a pressure regulator at any hose pressure from 10 to 125 psig or higher, depending on the supply air pressure. The invention disclosed in U.S. Pat. No. 5,083,402 substantially eliminates the source of flow rate variation and also modifies conventional equipment to handle blast media at low flow rates of from about 0.5 to 10 pounds per minute, preferably up to about 5 pounds per minute.

Figure 1:
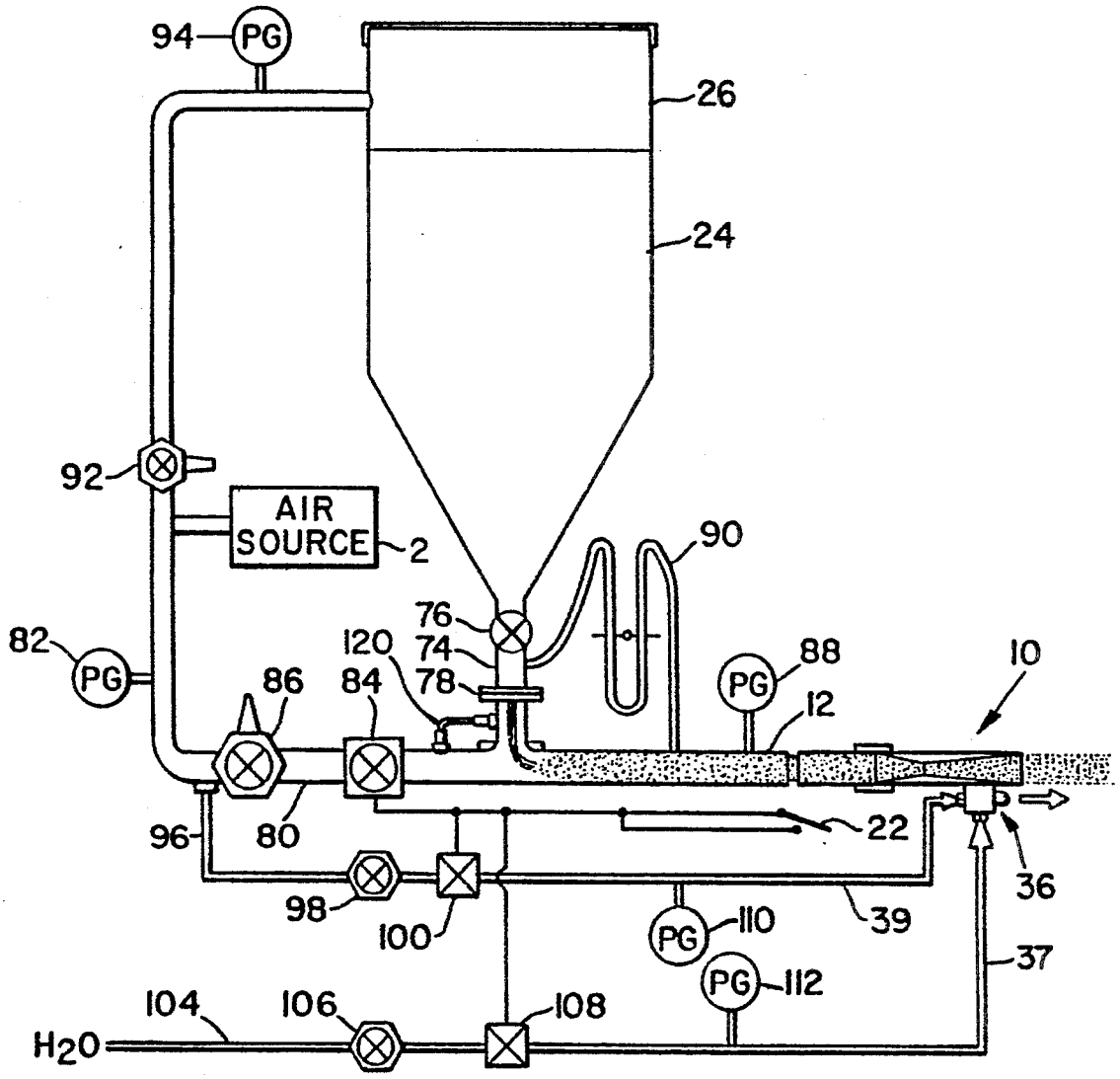
FIG. 1 a schematic illustration of the differential pressure metering and dispensing system of the invention.

The differential pressure metering system can now be described by reference to FIG. 1. Although the blast media illustrated is sodium bicarbonate, sodium sesquicarbonate, trona, other blast media such as potassium bicarbonate, ammonium bicarbonate, sodium chloride, sodium sulfate and other water-soluble salts are meant to be included herein. Referring to FIG. 1, the blast system includes supply pot 26 partially filled with blast media 24. The supply pot 26 suitably having a cavity of about 6 cubic feet, terminates in a media exit line 74 governed by a media control valve 76. The media control area can be further limited by an orifice plate 78 which further restricts the flow of the media 24 to the desired flow rate. A line 80 is connected to a source 2 of pressurized air and is monitored with an inlet monitor 82. Air valve 84 is a remotely operated on/off valve that activates the air flow to blast nozzle 10 and the opening and closing of the media control valve 76. Nozzle pressure regulator valve 86 regulates the nozzle pressure by means of a monitor 88 when the system is in operation. Nozzle pressure regulator valve 86 can maintain the desired nozzle pressure. The nozzle pressure monitor 88 enables a controlled pressure to be applied to the nozzle 10. The differential pressure gauge 90 monitors the pressure between the supply pot 26 and the supply hose 12. The pot pressure regulator 92, measured by gauge 94, is used to provide a pressure higher than the pressure in the conveying hose 12, thus allowing the differential pressure to be monitored by differential pressure gauge 90.

In operation, the blast media 24 is fed through media exit line 74 governed by the media control valve 76 to an orifice plate 78, which further regulates the flow of media to the compressed air line 80. The orifice openings can vary from about 1/16 to about ¼ inch diameter, or openings corresponding to the area provided by circular orifices of 1/16 to ¼ inch diameter. Preferably, the openings correspond to about a 0.125 inch opening for sodium bicarbonate media having a mean particle size of about 70 microns, and 0.156 inch opening for a media having a mean particle size from about 250 to about 300 microns. A positive pressure of between about 1 to 5 psig preferably about 2 to 4 psig between the media exit line 74 and the conveying hose 12 is maintained at all times. A source of compressed air is fed to the air line 80, regulated by the valves 84 and 86 to the desired air pressure and nozzle pressure, respectively, which preferably is between about 30 to about 150 psi, and more preferably between about 40 and 85 psi. The pot pressure regulator 92 controls the pressure to the top of the supply pot 26, further ensuring a controlled and uniform flow of blast media 24. The manometer or other differential pressure gauge 90 measures the differential pressure, which is proportional to the amount of media flowing through the orifice 78. The blast media and compressed air are delivered to the nozzle 10 and ejected toward the workpiece at a uniform and controllable rate. Optional equipment for protection of and cooling of the workpiece and, in particular, for the control of dust is provided by a water atomizer 36 which directs a spray of atomized water toward the work surface. A more detailed description of the water atomizer is disclosed in copending, commonly assigned U.S. application Ser. No. 958,552, filed Oct. 8, 1992, the contents of which are herein incorporated by reference. The operation of the water atomizer nozzle 36 is similar to that described for the blast nozzle 10 above. Thus, air typically from the same supply which feeds blast nozzle 10 is directed through line 96 and the pressure thereof controlled by pressure regulator valve 98. Hose 39 directs the pressurized air to the appropriate air inlet port in the nozzle body of the water atomizer 36. Valve 100 is a on/off valve which is activated by the spring loaded deadman switch 22 which is controlled by the operator. Water for the water atomizer nozzle 36 is directed from a supply (not shown) and passed through line 104. The pressure is controlled by pressure regulator valve 106. Water through hose 37 is passed to a water inlet port of the nozzle body of water atomizer 36. On/off valve 108 again is controlled by deadman switch 22. Pressure gauges 110 and 112 indicate to the users the pressures in lines 96 and 104, respectively. All of the on/off valves 84, 100 and 108 are controlled by the operator through the deadman switch 22 and, thus, all flow of air, abrasive media and water to blast nozzle 10 and the water atomizer 36 can be activated and cut off by the spring activated switch which is typically in the form of a hand-held trigger adjacent the blast nozzle.

Figure 2:
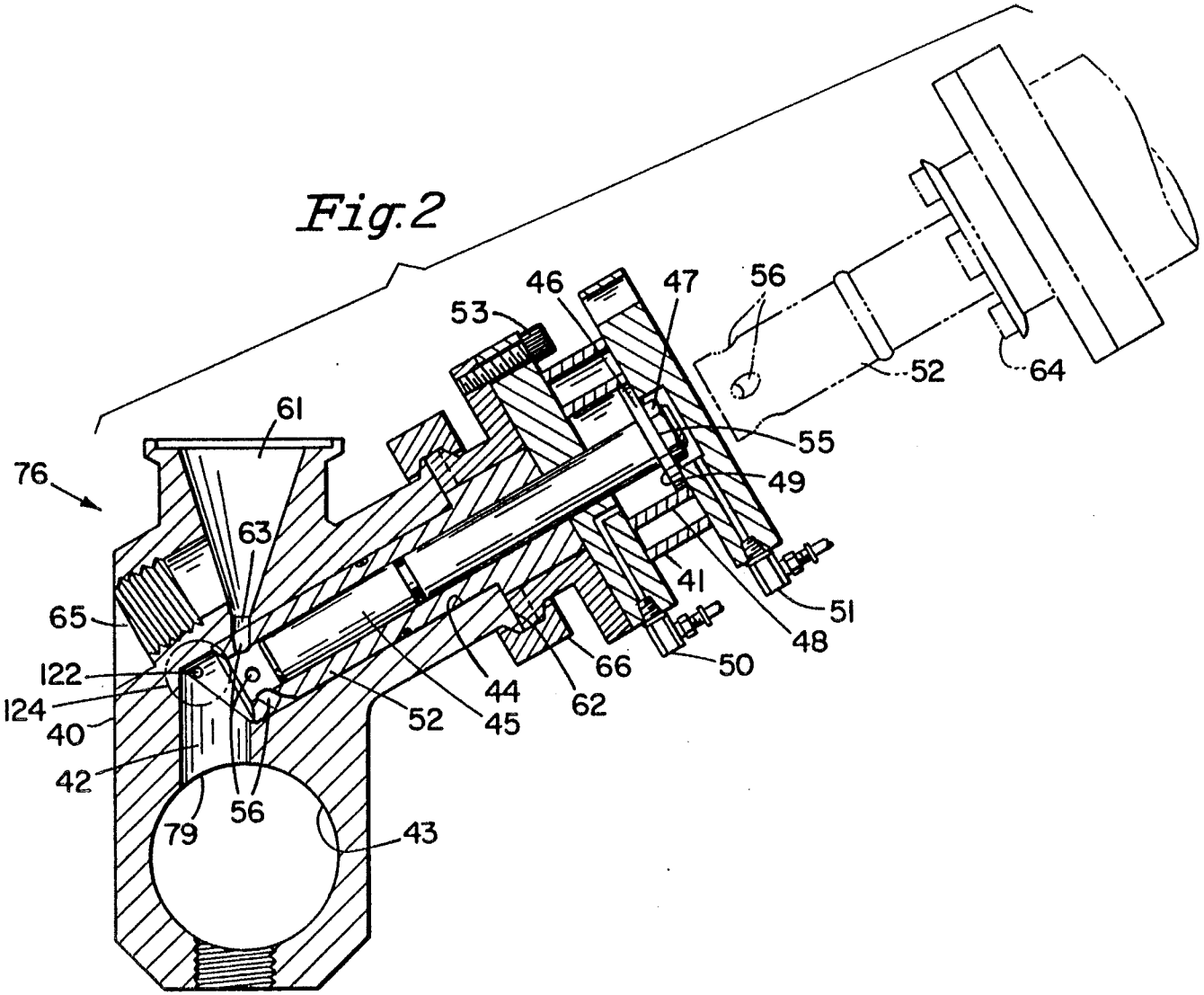
FIG. 2 is a cross-section of a media control valve useful in the differential pressure metering and dispensing system of this invention.

The media control valve 76 useful in the metering and dispensing system shown in FIG. 1 can be the valve shown in U.S. Pat. No. 3,476,496 or similar valves including the improved media valve described in aforementioned commonly assigned U.S. Ser. No. 161,530. The improved valve includes orifice 78 and is illustrated in FIG. 2. Improved valve 76 includes a valve body 40. A substantially vertical connector (not shown) can be connected with valve body 40 to communicate with the media outlet thereabove within the supply pot 26. The connector extends down and joins with inlet cone 61. Vertical media passage 63 within valve body 40 communicates with inlet cone 61 downstream thereof and further communicates with downstream vertical discharge tube 42 within valve body 40. Discharge tube 42 communicates with a downstream horizontal air flow tube 43 which may be formed as part of valve body 40 or attached thereto by welding and the like. The air flow tube 43 is disposed substantially perpendicular to the vertical discharge tube 42 and communicates with media passage 63, except for when a valve stem 45 is positioned to close the valve and prevent media flow therethrough. Valve stem 45 is placed within a bore 44 contained in valve body 40. Bore 44 is preferably disposed at an acute angle from vertical or is inclined with respect to the vertical discharge tube 42. The amount of angle is not critical and can be from about 20° to 90° from vertical. Valve stem 45 is movable within bore 44 to close and seal off discharge tube 42 from media passage 63 and prevent any of the abrasive or air pressure within the pot 26 and media passage 63 from entering the air flow tube 43.

A piston 46 is connected to, or is formed integrally with valve stem 45. Piston 46 can be threaded onto valve stem 45 and secured in place by lock nut 47. Piston 46 is placed in sealing engagement with the inside surface of pneumatic chamber 48 contained in cylinder 41 which is separate from valve body 40. The lower surface 49 of piston 46 is in communication by means of a connecting pressure supply tube 50 with air pressure supplied from the same air pressure source (not shown) which feeds air to air flow tube 43. Accordingly, compressed air applied to air flow tube 43 is also applied to the lower surface 49 of piston 46 to move piston 46 and attached valve stem 45 upward and out of communication with media passage 63. Valve stem 45 can be returned to the closed position when the air pressure on the lower surface 49 of piston 46 is reduced or eliminated. Compressed air can be provided via valve supply tube 51 to the top surface 55 of piston 46 in chamber 48 to lower valve stem 45.

Valve stem 45 does not act to meter the amount of abrasive media flowing from media passage 63, through discharge tube 42 and into air flow tube 43. Instead, valve stem 45 is an on-off valve which when retracted will allow free passage of the media from media passage 63, through discharge tube 42 and into air flow tube 43 and when closed will stop all passage of the media between media passage 63 and discharge tube 42. Valve stem 45 is slidable in a media control sleeve 52 which is placed within bore 44. Media control sleeve 52 is secured to pneumatic cylinder 41 by a pair of screws 53 and 54. Media control sleeve 52 contains a plurality of spaced orifices 56 of varying diameter and which can be placed into communication with media passage 63 to allow passage of the media through the orifice, into discharge tube 42 and air flow tube 43 when valve stem 45 is in the open position and displaced from media passage 63. Orifices 56 are the equivalent of orifice 78 as shown in the differential pressure media metering and dispensing system as shown in FIG. 1.

The media control valve 76 as shown herein is improved over prior art valves in that the media control sleeve 52 can be rotated while in place within bore 44 of valve body 40 so as to place one of the different orifices 56 in communication with media passage 63 and air flow tube 43 via discharge tube 42. In prior art devices, the valve body 40 had to be disassembled, the control sleeve removed entirely from the valve body, and rotated to align the desired orifice with the discharge tube and then returned to the valve body which was then reassembled. In valve 76, control sleeve 52 is manually rotatable in place within bore 44 and an index means is provided to align an orifice 56 with media passage 63 and to indicate to the user that the proper alignment has been made. Alternative index means are shown in aforementioned U.S. Ser. No. 161,530.

In the embodiment shown in FIG. 2, the index means used to properly align the orifices 56 with vertical media passage 63 includes a plurality of spaced grooves 62 which are contained at the face of bore 44 on valve body 40. Grooves 62 can be mated with a plurality of spaced teeth 64 spaced around the circumferential surface of control sleeve 52. The orifices 56 are aligned with teeth 64 such that when teeth 64 are mated within grooves 62 an orifice 56 is in proper alignment with media passage 63. To change the orifice 56 which is in alignment with media passage 63, the control sleeve 52 which is slidable within bore 44 is lifted enough to disengage teeth 64 from grooves 62, the control sleeve rotated so that the teeth 64 and groove 62 are again matched and the control sleeve then dropped into place to mate the teeth 64 with grooves 62 whereupon a different orifice is placed in alignment with media passage 63. It is not necessary that the control sleeve be removed completely from bore 44 and that there be required any disassembly of the valve body 40. By this manner, the media control sleeve does not need to be removed from valve body 40 to change orifice size and thus the proper metering of the media through the valve can be controlled by simply rotating in place the media control sleeve 52. As an example, the media control sleeve 52 can contain four orifices having, but not limited to, a size of 0.125, 0.156, 0.187, and 0.209 inch in diameter. The exact size of the orifices is not critical to the invention and the listed sizes are for illustrative purposes only.

Another important aspect of the improved valve 76 is that the media control sleeve 52 can be removed from the valve body for cleaning without any disassembling of the valve body 40. Since the media control sleeve 52 is secured to pneumatic cylinder 41 and valve stem 45 is also secured within chamber 48 and fits within the sleeve 52, the whole assembly comprising cylinder 41, chamber 48, media control sleeve 52, valve stem 45 and piston 46 can be slidably removed in one piece from bore 44 of valve body 40. Alternative means to lock and unlock the sleeve assembly within bore 44 can be provided. As shown in FIG. 2, a clamp 66 attached to the exterior of valve body 40 secures sleeve 52 thereto. Again, there is no need to disassemble the valve body or the media control sleeve to remove same from the valve body to allow cleaning of the assembly. Valve 76 also includes a passage 65 to clean out the discharge tube 42 and passage 63 by application of back pressure.

In the operation of the media valve 76 in combination with a supply pot 26, pot 26 is filled, or partially filled with, abrasive. After the abrasive is within the pot 26, it is pulled or is otherwise moved to the location for the blast cleaning operation. Supply pot 26 is then connected to a suitable source of compressed air. The compressed air or gas pressurizes the pot 26 and can also be used to supply the air pressure to the air flow tube 43 and air supply tube 50 of valve 76. Thus, pot 26 is pressurized and the valve 76 is automatically opened by displacement of valve stem 45 out of communication with media passage 63 substantially simultaneously. This results in a pressurized flow of the abrasive downwardly through the vertical media passage 63, through one of orifices 56 in control sleeve 52, into discharge tube 42 and dispensed into the pressurized air stream flowing through air flow tube 43. The pressure within air flow tube 43 acts to force the abrasive outwardly to the discharge connection where one or more abrasive blasting hoses with suitable nozzles are connected, as will be well understood.

As the compressed air flows through air flow tube 43 and passes across the outlet 79 of discharge tube 42 into air flow tube 43, there can occur turbulence as the air flows across the circular outlet. This turbulent flow can extend up into the discharge tube 42 to cause a difference in the pressure of air immediately below orifice 56 (78) than what is present in the air line 80 supplying air to air flow tube 43. Inasmuch as the pressure of air supplied to pot 26 is calculated to be greater than the air in the air line by a predetermined amount to control the flow of media across the orifice, the modified air pressure immediately below the orifice due to air turbulence can cause fluctuations in the amount of media crossing the orifice and may result in media concentrations in the air stream which were not intended. Again, since the media concentration in the air line, in particular, with sodium bicarbonate media, is relatively low, small deviations of concentration can have more pronounced results in the blast cleaning operation than would be found by the use of a heavier abrasive such as sand which is typically present in higher concentrations in the compressed air stream. To reduce the effect on the differential pressure metering and dispensing system as shown in FIG. 1 that air turbulence across outlet 79 of discharge tube 42 causes, an equalization tube 120 is placed to provide communication between air line 80 upstream of outlet 79 and the area immediately below orifice 78 (FIG. 1). Equalization tube 120 is threaded into boss 124 cast or welded onto valve body 40 and secured thereto by means of nuts 126 and similarly threaded into boss 128 on air line 80 and secured by nuts 130, FIG. 3. The equalization tube 120 equalizes the pressure in the area below orifice 78 to the pressure in the upstream air line 80. Thus, the media passing through orifice 78 "sees" the regulated and expected air pressure in air line 80. Equalization tube 120 allows the maintenance of the calculated and regulated differential pressure between pot 76 and the air below orifice 78 and provides for the calculated and uniform metering of the abrasive media across orifice 78 and into the compressed air stream. As shown in FIG. 2, equalization tube 120 communicates with bore 44 immediately below orifice 56 in media control sleeve 52. The equalization tube typically will have an inside diameter of $\frac{1}{8}$ inch and a port 122 into bore 44 of media valve 76 of approximately 1/16 inch in diameter which is sufficient to equalize the pressure between the air line 80 and the air immediately below orifice 56 and at the same time prevent any significant quantities of media from back flowing into the equalization tube 120.

Figure 3:
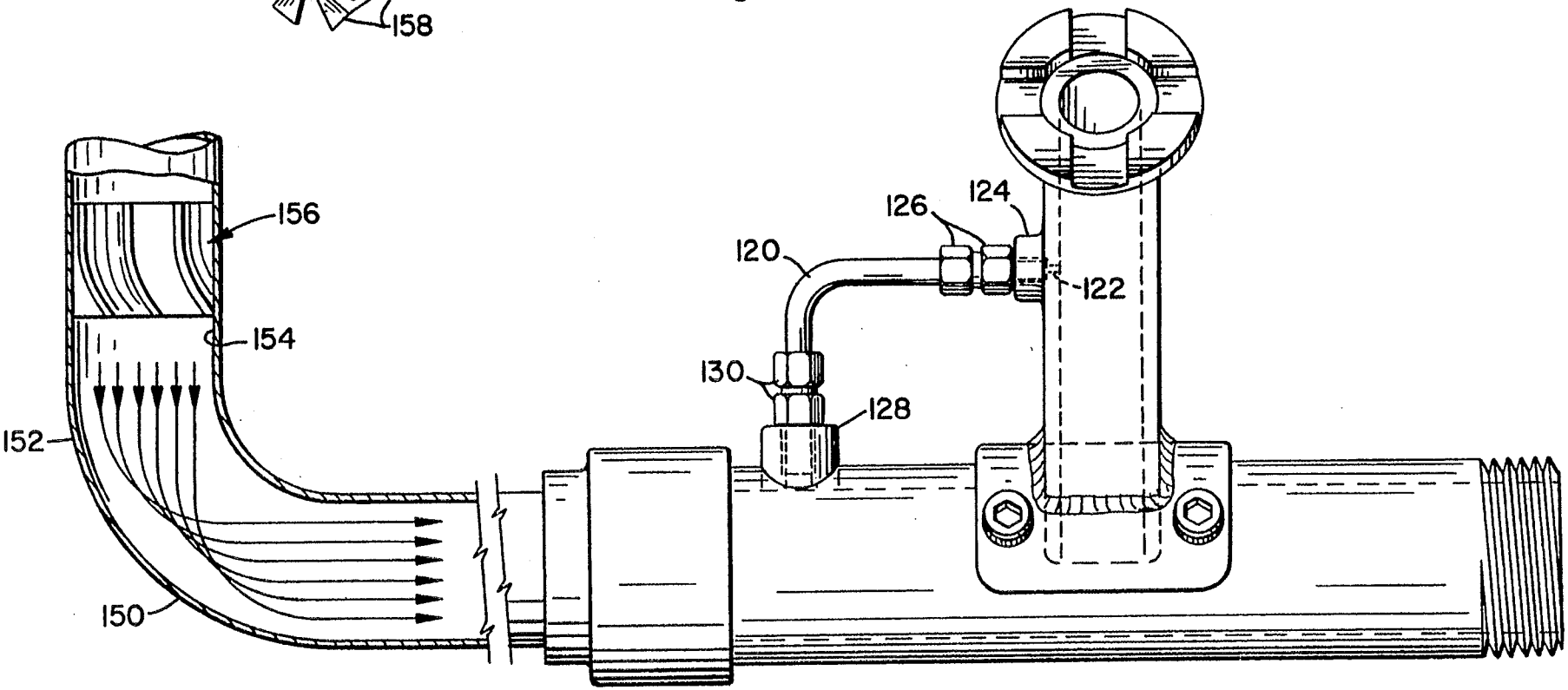
FIG. 3 is an elevational and schematic view of the equalization tube, air flow straightening device upstream of the metering system of this invention and the air flow subsequent to passing through the straightening device.
Figure 4:
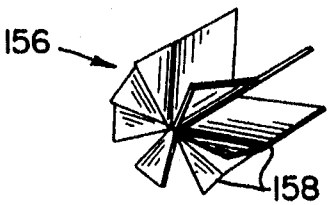
FIG. 4 is a perspective view of a useful air flow straightening device.

Another source of turbulent air passing across outlet 79 into air flow tube 43 is caused by an elbow typically placed in the air line upstream of the metering and dispensing means. Referring now to FIGS. 1 and 3, the source 2 of compressed air is typically secured to or placed adjacent the supply pot 26 due to the confines of space. The compressed air line 80 passes down from compressed air source 2, bends at elbow 150 in approximately a 90° bend and then passes across the media metering valve 76 in air flow tube 43. When the compressed air passes through the elbow 150, the air separates transversely across the piping resulting in back mixing and low pressure along both the outer wall 152 and the inner wall 154 of elbow 150. The main air flow is squeezed through a reduced cross sectional area between the back-mixed areas resulting in increased local velocity and enhanced separation. The disturbance of separation and back mixing can be carried downstream of air line 80 and across the outlet 79 of discharge tube 42, again resulting in turbulent air in discharge tube 42 and a nonuniform and undesirable metering of the media across the orifice 78. In accordance with the present invention, an air flow straightening device 156 is inserted in air line 80 upstream of elbow 150. As shown in FIGS. 3 and 4, the flow straightening device comprises a set of curved stationery vanes 158 which introduce a rotational effect into the air as the air stream enters elbow 150. The flow straightening device 156 enables the compressed air to negotiate the turn of elbow 150 with all stream elements spaced transversely across elbow 150 traveling the same distance from the entrance of elbow 150 to the exit thereof reducing the separation of the air flow and greatly reducing, if not eliminating, back mixing along the inner and outer walls 154 and 152, respectively of elbow 150. The uniform exit flow of the compressed air stream beyond elbow 150 is maintained until the flow again reaches outlet 79 of discharge tube 42. The uniform air flow across the inlet of equalization tube 120, however, insures correct line air pressure will be produced in the area immediately below orifice 78. A preferred flow straightening device is the CRV ® straightener from Koch Engineering, Wichita, Kans. which is shown in FIG. 4.

What is claimed is:

1. In an apparatus for blasting, comprising:

a pressure vessel means for containing a quantity of particulate abrasive blasting medium;

a source of pressurized air and means for pressurizing said pressure vessel by providing fluid communication between said pressure vessel and said source of pressurized air;

means for feeding said blasting medium from said pressure vessel to a media outlet from said feeding means to an air conveying line to form a mixture of blasting medium and pressurized air; said air conveying line being in fluid communication with said source of pressurized air;

an orifice in said feeding means upstream of said media outlet for restricting the flow of said blasting medium to said air conveying line;

means for separately controlling the pressure in said pressure vessel and in said conveying line to provide a pressure differential such that the pressure level within said pressure vessel is greater than the pressure within said conveying line; and means for discharging said mixture of blasting medium and pressurized air through a nozzle at the end of said conveying line, the improvement comprising;

equalization means to equalize the pressure between said conveying line upstream of said media outlet and said feeding means immediately downstream of said orifice.

2. The improvement of claim 1 wherein said equalization means comprises a tube having an inlet into said conveying line upstream of said media outlet and an outlet to said feeding means immediately downstream of said orifice.

3. The improvement of claim 1 wherein said orifice has an opening corresponding to the area provided by circular orifices of about 0.063 to 0.156 inch diameter.

4. The improvement of claim 2 wherein said orifice has an opening corresponding to the area provided by circular orifices of about 0.063 to 0.156 inch diameter.

5. The improvement of claim 3 wherein said orifice is circular.

6. The improvement of claim 1 wherein said conveying line upstream of said media outlet contains a bend sufficient to result in air separation and back-mixing transversely across said bend and air turbulence downstream of said bend, said improvement further comprising an air flow straightening means provided in said conveying line upstream of said bend so as to reduce said back-mixing and downstream turbulence.

7. The improvement of claim 6 wherein said flow straightening means provides a rotational flow to the air in said conveying line and causes all transverse elements of the air stream to travel approximately the same distance through said bend.

8. The improvement of claim 7 wherein said flow straightening means comprises a plurality of curved vanes to provide said rotational flow of said air through said bend.

9. In an apparatus for blasting, comprising:

a pressure vessel means for containing a quantity of particulate abrasive blasting medium;

a source of pressurized air and means for pressurizing said pressure vessel by providing fluid communication between said pressure vessel and said source of pressurized air;

means for feeding said blasting medium from said pressure vessel to a media outlet from said feeding means to an air conveying line to form a mixture of blasting medium and pressurized air; said air conveying line being in fluid communication with said source of pressurized air and containing a bend upstream of said media outlet, said bend sufficient to result in air separation and back-mixing transversely across said bend and air turbulence downstream of said bend;

an orifice in said feeding means upstream of said media outlet for restricting the flow of said blasting medium to said air conveying line;

means for separately controlling the pressure in said pressure vessel and in said conveying line to provide a pressure differential such that the pressure level within said pressure vessel is greater than the pressure within said conveying line; and means for discharging said mixture of blasting medium and pressurized air through a nozzle at the end of said conveying line, the improvement comprising;

an air flow straightening means provided in said conveying line upstream of said bend so as to reduce said back-mixing and downstream turbulence.

10. The improvement of claim 9 wherein said air flow straightening means provides a rotational flow to the air in said conveying line and causes all transverse elements of the air stream to travel approximately the same distance through said bend.

11. The improvement of claim 10 wherein said air flow straightening means comprises a plurality of curved vanes to provide said rotational flow of said air through said bend.

12. In a method for blasting, comprising the steps of:

containing a quantity of blasting medium comprised of fine particles having a mean particle size of from about 50 to 1000 microns within a pressure vessel;

pressurizing said pressure vessel by providing fluid communication between said pressure vessel and a source of pressurized air;

feeding said blasting medium from said pressure vessel, through a media discharge line to a media outlet into a conveying line, said conveying line being in fluid communication with said source of pressurized air;

restricting the flow of said blasting medium to said conveying line at a flow rate of from about 0.5 to 10 pounds per minute through an orifice in said media discharge line and having a predetermined area and which is upstream of said media outlet.

mixing said blasting medium with the stream of pressurized air flowing within said conveying line;

controlling the pressure in said pressure vessel and in said conveying line to provide a pressure differential such that the pressure level within said pressure vessel is greater than the pressure within said conveying line;

regulating said pressure differential in proportion to the flow of blasting medium through said orifice to provide a blasting medium-to-air ratio in the conveying line of between about 0.05 and 0.5 by weight; and discharging said mixture of blasting medium and said stream of pressurized air through a nozzle at the end of said conveying line, the improvement comprising;

equalizing the air pressure between the conveying line at a location upstream from said outlet and the media discharge line immediately downstream of said orifice and upstream from said outlet.

13. The method of claim 12 wherein a tube is placed between said location of said conveying line upstream from said outlet and said discharge line immediately downstream of said orifice to provide direct communication therebetween.

14. The method of claim 12 wherein the blasting medium comprises sodium bicarbonate potassium bicarbonate, ammonium bicarbonate, sodium sesquicarbonate, sodium chloride, sodium sulfate or mixtures thereof.

15. The method of claim 12 wherein the pressurized air pressure is between about 20 to 125 psig.

16. The method of claim 12 wherein the pressure differential is between about 1 and 5 psi.

17. The method of claim 16 wherein the pressure differential is between about 2 and 4 psi.

18. The method of claim 12 wherein the flow rate of blasting medium through the orifice is between about 0.5 to 5 pounds per minute.

19. The method of claim 12 wherein the orifice has an opening corresponding to the area provided by circular orifices of about 0.063 to 0.156 inch diameter.

20. The method of claim 19 wherein the orifice is circular.

* * * * *